US007922602B2

(12) United States Patent
Johnson

(10) Patent No.: US 7,922,602 B2
(45) **Date of Patent: *Apr. 12, 2011**

(54) VERTICALLY CURVED FACE PUTTER WITH MULTIPLE HORIZONTAL CONTACT FACETS

(76) Inventor: Lanny L. Johnson, Okemos, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/830,532

(22) Filed: Jul. 6, 2010

(65) Prior Publication Data

US 2010/0304885 A1 Dec. 2, 2010

Related U.S. Application Data

(60) Division of application No. 12/433,601, filed on Apr. 30, 2009, now Pat. No. 7,749,098, which is a continuation-in-part of application No. 11/764,209, filed on Jun. 17, 2007, now abandoned, which is a division of application No. 11/408,830, filed on Apr. 21, 2006, now abandoned, which is a continuation-in-part of application No. 11/173,066, filed on Jul. 1, 2005, now abandoned, which is a continuation-in-part of application No. 10/672,185, filed on Sep. 26, 2003, now Pat. No. 6,962,537.

(51) Int. Cl.
*A63B 53/04* (2006.01)

(52) U.S. Cl. ..... 473/330; 473/331; 473/340

(58) Field of Classification Search ..... 473/330–331, 473/340–341, 345, 342

See application file for complete search history.

(56) References Cited

U.S. PATENT DOCUMENTS

| | | | |
|---|---|---|---|
| 1,532,545 | A | 4/1925 | Pedersen |
| 2,665,909 | A | 1/1954 | Wilson |
| 3,199,873 | A | 8/1965 | Surratt |

(Continued)

FOREIGN PATENT DOCUMENTS

| | | |
|---|---|---|
| JP | 8-150233 | 6/1996 |

(Continued)

OTHER PUBLICATIONS

International Searching Authority (USPTO), International Search Report and Written Opinion for International Application No. PCT/US10/32335, mailed Jun. 29, 2010, 8 pages.

*Primary Examiner* — Stephen L. Blau
(74) *Attorney, Agent, or Firm* — Gallagher & Dawsey Co., LPA; Michael J. Gallagher; David J. Dawsey

(57) ABSTRACT

A golf putter head having a vertically curved putter face with multiple horizontal contact facets. The face has a vertical radius of curvature that is at least 2 inches and no more than 3.5 inches. The face includes a plurality of horizontal contact facets that are vertically curved to match the vertical radius of curvature. The contact facets, along with the radius of curvature, ensure that no more than two of the horizontal contact facets contact the golf ball when struck by the putter head at a speed of less than 15 miles per hour. The putter produces a horizontal linear contact, or impact, geometry that compensates for misdirection of the path of the putter head throughout the stroke of the putter head. At least one of the horizontal contact facets is located at an elevation above the center of curvature and at least one is located below.

6 Claims, 6 Drawing Sheets

U.S. PATENT DOCUMENTS

| | | | | |
|---|---|---|---|---|
| 3,730,529 | A | | 5/1973 | Donofrio |
| D248,181 | S | | 6/1978 | Cervantes |
| 4,162,074 | A | | 7/1979 | Thomson |
| 4,165,076 | A | | 8/1979 | Cella |
| 4,498,673 | A | | 2/1985 | Swanson |
| 4,529,202 | A | | 7/1985 | Jacobson |
| D303,825 | S | | 10/1989 | Burns |
| 4,872,684 | A | | 10/1989 | Dippel |
| 4,902,015 | A | | 2/1990 | Nebbia |
| 5,193,806 | A | | 3/1993 | Burkly |
| 5,294,122 | A | | 3/1994 | Longo |
| 5,354,060 | A | | 10/1994 | Wooten |
| 5,433,441 | A | | 7/1995 | Olsen et al. |
| 5,467,538 | A | | 11/1995 | Chou et al. |
| 5,467,987 | A | | 11/1995 | Perkins et al. |
| 5,531,439 | A | | 7/1996 | Azzarella |
| 5,542,675 | A | | 8/1996 | Micciche et al. |
| 5,618,239 | A | | 4/1997 | Rife |
| 5,632,694 | A | | 5/1997 | Lee |
| 5,637,044 | A | | 6/1997 | Swash |
| 5,709,616 | A | | 1/1998 | Rife |
| 5,716,290 | A | * | 2/1998 | Baker et al. ..... 473/313 |
| 5,718,644 | A | | 2/1998 | Donofrio |
| D396,257 | S | | 7/1998 | Spano |
| 6,095,931 | A | | 8/2000 | Hettinger et al. |
| 6,155,934 | A | | 12/2000 | Pinns |
| 6,179,727 | B1 | | 1/2001 | Giordano |
| 6,183,379 | B1 | | 2/2001 | Kim et al. |
| 6,224,497 | B1 | | 5/2001 | Antonious |
| 6,270,423 | B1 | | 8/2001 | Webb |
| 6,322,459 | B1 | | 11/2001 | Nishimura et al. |
| 6,340,336 | B1 | | 1/2002 | Loconte |
| 6,450,894 | B1 | | 9/2002 | Sun et al. |
| 6,458,043 | B1 | | 10/2002 | McCabe et al. |
| 6,464,598 | B1 | | 10/2002 | Miller |
| 6,517,450 | B1 | | 2/2003 | Klyve |
| 6,520,865 | B1 | | 2/2003 | Fioretti |
| 6,524,193 | B1 | | 2/2003 | Devore |
| 6,533,678 | B1 | | 3/2003 | Johnson |
| 6,554,721 | B1 | | 4/2003 | Woodward et al. |
| 6,595,869 | B2 | | 7/2003 | McCabe et al. |
| 6,849,004 | B2 | | 2/2005 | Lindsay |
| 7,086,959 | B2 | | 8/2006 | D'Agguano |
| 7,169,058 | B1 | | 1/2007 | Fagan |
| 2006/0094536 | A1 | * | 5/2006 | Morales ..... 473/342 |

FOREIGN PATENT DOCUMENTS

| | | |
|---|---|---|
| JP | 9-56854 | 3/1997 |
| JP | 2002-306648 | 10/2002 |

* cited by examiner

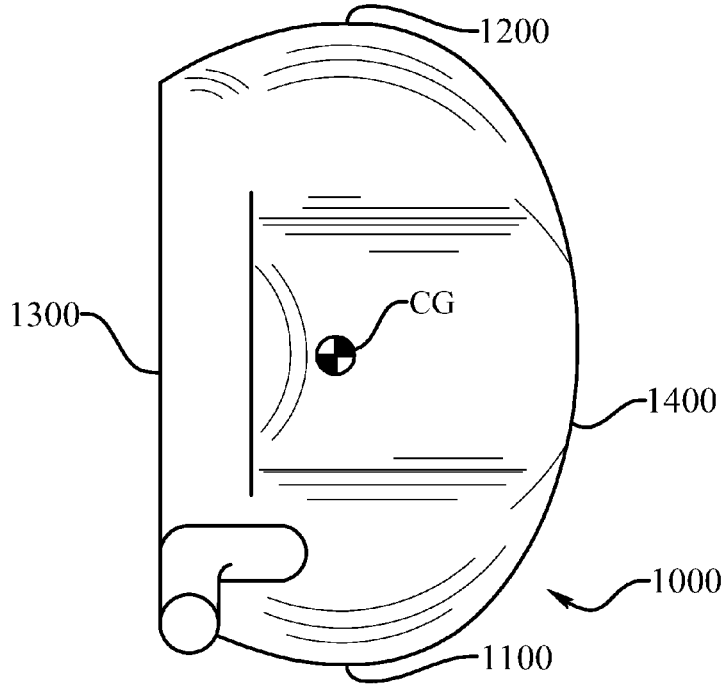
Fig. 3
Fig. 4
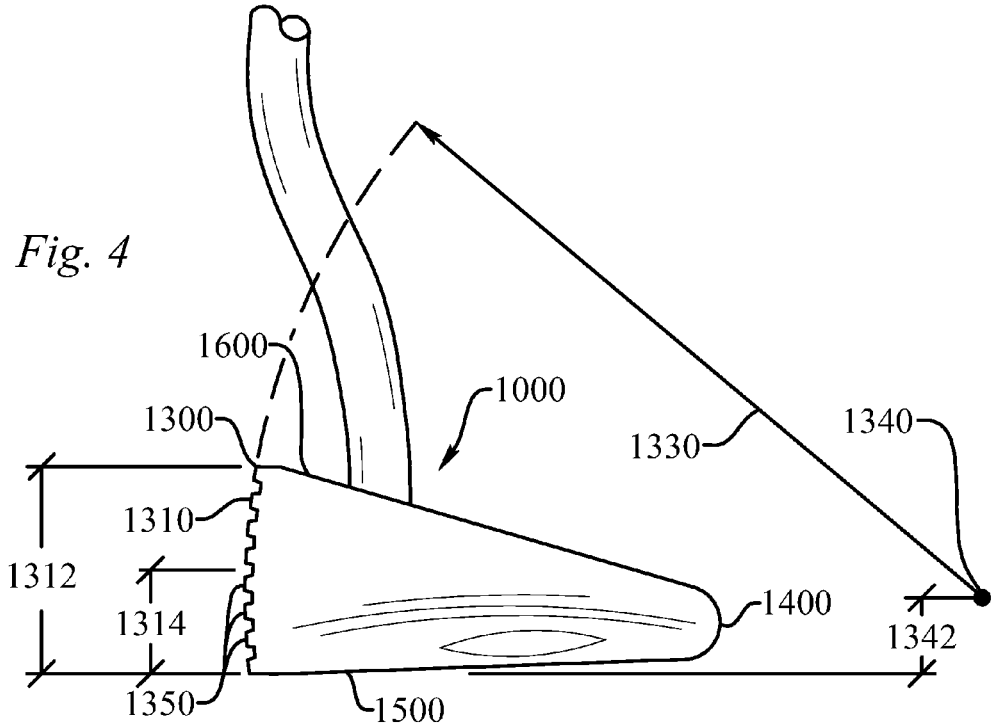

VERTICALLY CURVED FACE PUTTER WITH MULTIPLE HORIZONTAL CONTACT FACETS

CROSS-REFERENCE TO RELATED APPLICATIONS

This application is a divisional of U.S. patent application Ser. No. 12/433,601, filed on Apr. 30, 2009, now U.S. Pat. No. 7,749,098 which was a continuation-in-part of U.S. patent application Ser. No. 11/764,209, filed on Jun. 17, 2007, and is now abandoned, which was a divisional of U.S. patent application Ser. No. 11/408,830, filed on Apr. 21, 2006, and is now abandoned, which was a continuation-in-part of U.S. patent application Ser. No. 11/173,066, filed on Jul. 1, 2005, and is now abandoned, which was a continuation-in-part of U.S. patent application Ser. No. 10/672,185, filed on Sep. 26, 2003, and is now U.S. Pat. No. 6,962,537; all of which are incorporated by reference as if completely written herein.

STATEMENT REGARDING FEDERALLY SPONSORED RESEARCH OR DEVELOPMENT

Not Applicable

BACKGROUND OF THE INVENTION

Golf putter designs often focus on proper alignment and minimizing the effects of off-center hits toward the toe or heel. However, many problems associated with a golfer's putting can be linked to a putting stroke that cuts across the ball, or unnecessarily lofts or delofts the putter face at impact. The present putter head is directed to reducing the deleterious effects of these putting stroke defects.

SUMMARY OF THE INVENTION

The present golf putter head is characterized by a vertically curved putter face with multiple horizontal contact facets. The putter face has a ball contact portion that is curved vertically having a vertical radius of curvature and a center of curvature. The vertical radius of curvature is at least 2 inches and no more than 3.5 inches. This range has been found to provide the exceptional performance attributes disclosed herein while also being aesthetically pleasing to the golfer's eye. A portion of the ball contact portion is above a center of curvature elevation and a portion of the ball contact portion is below the center of curvature elevation, and the center of curvature elevation is less than a face height midpoint elevation.

The ball contact portion includes a plurality of horizontal contact facets, wherein each contact facet has a facet width and a facet length. Each contact facet is vertically curved to match the vertical radius of curvature. The horizontal contact facets, along with many other factors including, but not limited to, the radius of curvature, ensures that no more than two of the plurality of horizontal contact facets contact the golf ball when struck by the ball contact portion at a putter head speed of less than 15 miles per hour. This produces a horizontal linear contact, or impact, geometry that compensates for misdirection of the path of the putter head throughout the stroke of the putter head.

At least one of the horizontal contact facets is located at an elevation above the center of curvature elevation and at least one is located at an elevation below the center of curvature elevation. This location of at least two horizontal contact facets accommodates another common flaw of the amateur putting stroke, namely the lofting or delofting of the face at impact. Amateurs commonly have the shaft at an angle other than perfectly vertical at the point when the face impacts the golf ball.

BRIEF DESCRIPTION OF THE DRAWINGS

Without limiting the scope of the present vertically curved face putter with multiple horizontal contact facets as claimed below and referring now to the drawings and figures:

FIG. 3 shows a top plan view of an embodiment of the putter head, not to scale;

FIG. 4 shows a heel side elevation view of an embodiment of the putter head, not to scale;

Figure 1:
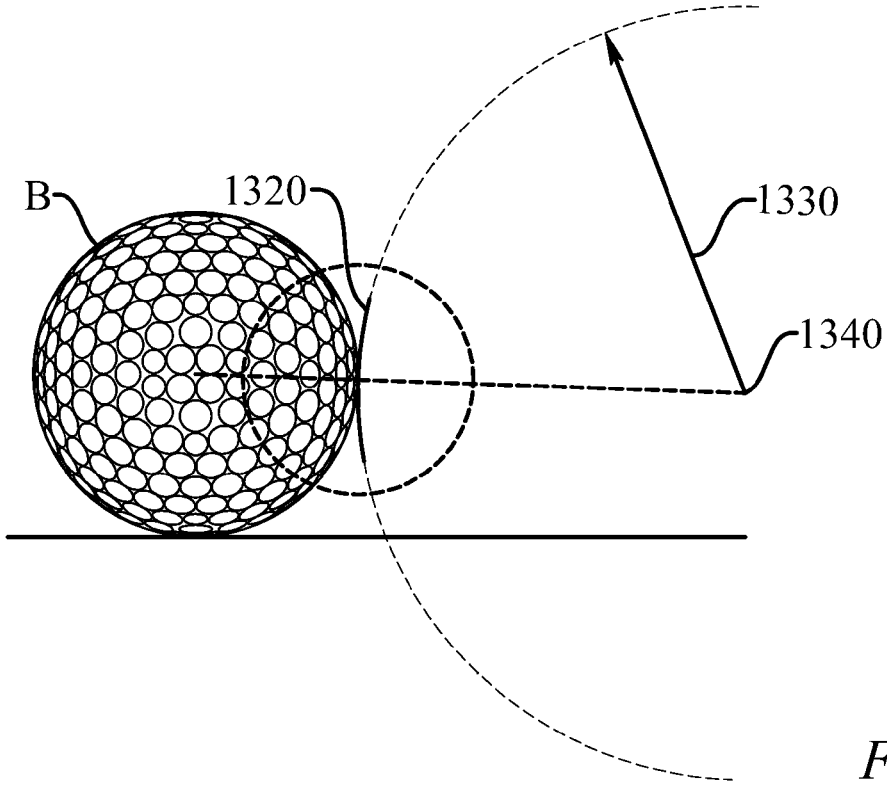
FIG. 1 shows a side elevation view of a golf ball and schematic representation of a face of the putter with a radius of curvature and a center of curvature, not to scale.

These drawings are provided to assist in the understanding of the exemplary embodiments of the vertically curved face putter with multiple horizontal contact facets, and the associated face onsert, as described in more detail below and should not be construed as unduly limiting the present putter head and face onsert. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

All patents, patent applications, government publications, government regulations, and literature references cited in this specification are hereby incorporated herein by reference in their entirety. In case of conflict, the present description, including definitions, will control. Definitions for the following terms are provided to promote a further understanding of the present invention.

The terms used throughout this document are common in the field of golf putters; however, a few of the terms are expressly defined. The term "contact area" as used herein refers to the area on either a putter face striking area or a golf ball where there is contact between the ball and the putter blade. The term "proximal" as used herein refers to the direction or portion of a putter near to the golfer when in use. The term "distal" as used herein refers to the direction or portion of a putter away from the golfer when in use. The term "front" as used herein refers to the edge of the putter head used by a right handed golfer as a striking surface for contacting a golf ball during putting. A "face" as used herein refers to any surface used to strike a golf ball. Some putters having a central shaft can be used in a right or left handed fashion under U.S.G.A. rules. Right handed designations are used herein with reference to the Figures; however, left handed uses and configurations are encompassed by the present invention. The term "ball contact portion" as used herein refers to a part of the striking face which is at or near to the center of the face. The term "back" as used herein refers to the side of the putter head opposed to the front striking face. In some embodiments of the putter head of the present invention, the back is also configured as a striking face with grooves so as to conform to USGA and R&A rules. The term "toe" as used herein refers to the side of the putter head which is distal to the golfer when putting. The term "heel" as used herein refers to the side of the putter head which is proximal to the golfer when putting. The term "horizontal" as used herein refers to an orientation parallel the ground upon which the golf ball lies. When used in reference to the putter head, it refers to a line which is horizontal when the putter rests on the ground and addresses the golf ball. Therefore the term "horizontal" refers to the ground and/or the bottom side of the club. The term "vertical" as used herein refers to an imaginary line which is normal to the horizontal plane of the ground upon which the golf ball lies or to the horizontal plane of the sole (bottom) of the club.

Figure 5:
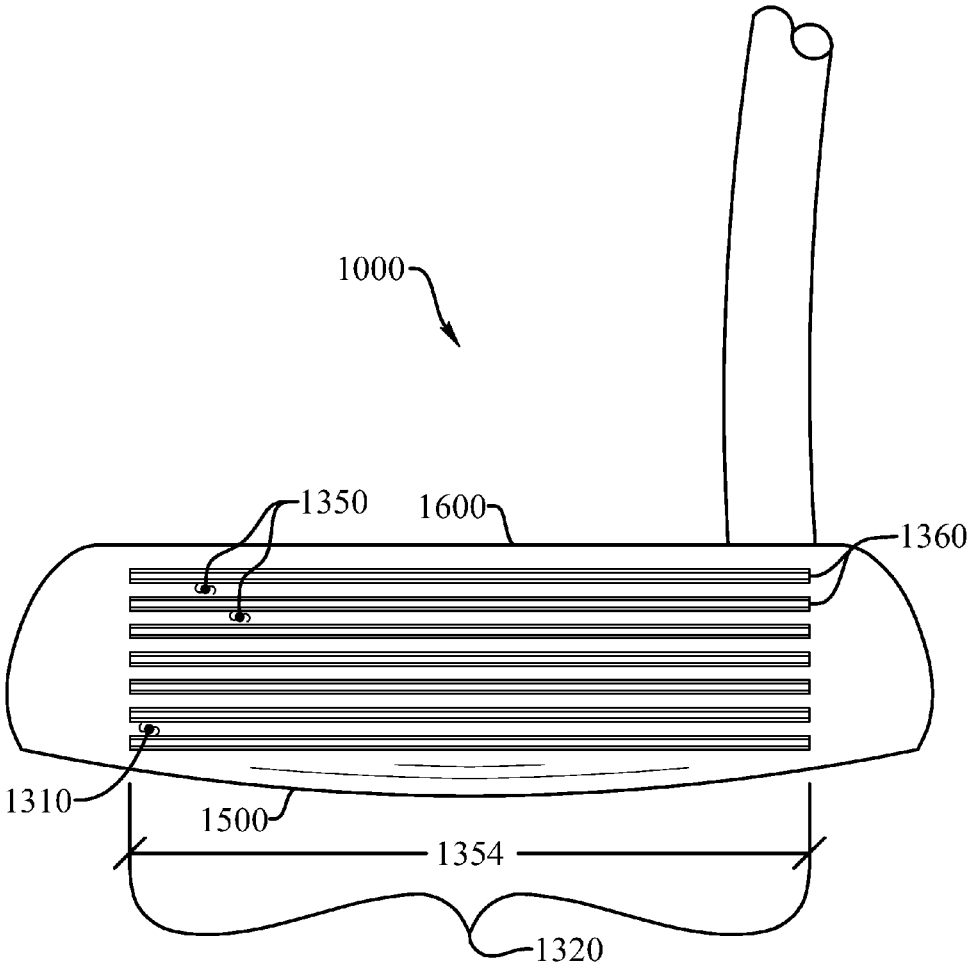
FIG. 5 shows a front elevation view of an embodiment of the putter head, not to scale.

The present golf putter head (1000) is designed to strike a golf ball (B) and is characterized by a vertically curved putter face with multiple horizontal contact facets (1350). Now, with general reference to FIGS. 3-5, the golf putter head (1000) has a putter body having a heel (1100), a toe (1200), a front (1300), a back (1400), a sole (1500), and a top (1600). Referring now to FIGS. 4 and 5, the front (1300) includes a face (1310) having a face height (1312), a face height midpoint elevation (1314), and a ball contact portion (1320).

As seen in FIG. 1, the ball contact portion (1320) is curved vertically having a vertical radius of curvature (1330) and a center of curvature (1340). The vertical radius of curvature (1330) is at least 2 inches and no more than 3.5 inches. Further, as seen in FIG. 4, a portion of the ball contact portion (1320) is above a center of curvature elevation (1342) and a portion of the ball contact portion (1320) is below the center of curvature elevation (1342), and the center of curvature elevation (1342) is less than the face height midpoint elevation (1314).

Figure 6:
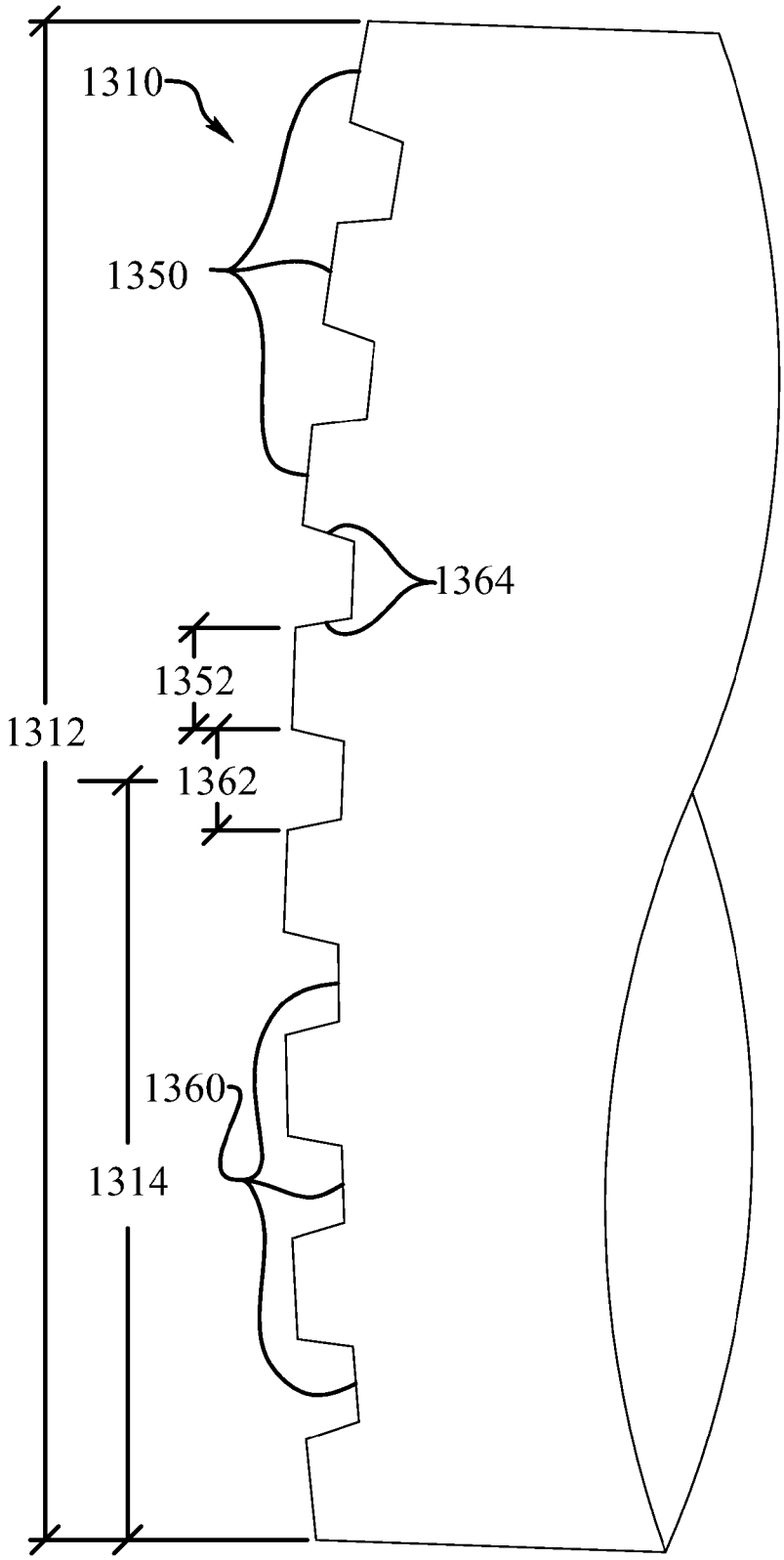
FIG. 6 shows an enlarged partial cross sectional view of an embodiment of the putter head, not to scale.

As seen best in FIGS. 4 and 6, the ball contact portion (1320) includes a plurality of horizontal contact facets (1350), wherein each contact facet (1350) has a facet width (1352) and a facet length (1354). Each contact facet (1350) is vertically curved to match the vertical radius of curvature (1330), thus it is common for the putter face (1310) to be precisely milled to the vertical radius of curvature (1330) prior to the creation of the individual contact facets (1350). Thus, any imaginary lines extending perpendicular to the surface of any of the individual contact facets (1350) would pass through the center of curvature (1340).

The facet width (1352) is no greater than 0.07 inches. One skilled in the art will recognize that the sizes of the dimples on golf balls (B) generally range from about 0.11 inches to about 0.185 inches. The facet width (1352) has been selected to be less than about ⅔ of the diameter of the smallest size of common golf ball (B) dimples, or no greater than 0.07 inches. This facet width (1352), along with many other factors including, but not limited to, the radius of curvature (1330), ensures that no more than two of the plurality of horizontal contact facets (1350) contact the golf ball (B) when struck by the ball contact portion (1320) at a putter head (1000) speed of less than 15 miles per hour. This produces a horizontal linear contact, or impact, geometry that compensates for misdirection of the path of the putter head (1000) throughout the stroke of the putter head (1000).

As such, the linear impact geometry created by horizontal contact facets (1350) reduces the influence that a "cutting of the ball" stroke has on the direction of the golf ball (B) as it leaves the putter head (1000) after impact. Thus, the horizontal contact facets (1350) reduce the negative effects of the common amateur outside-in putting stroke or inside-out putting stroke. In fact, the horizontal contact facets (1350), and the associated linear impact geometry produced by no more than two contact facets (1350) touching the golf ball (B) at impact, virtually negate the influence on the direction of the golf ball (B) after impact for amateur putting strokes that deviate from an ideal straight back straight through putting stroke by as much as 15 degrees. In other words, a putting stroke that is cutting across the golf ball (B) at impact, from 15 degrees outside a straight back straight forward stroke to 15 degrees inside a straight back straight forward putting stroke, ends up having very little influence on the line of the golf ball (B) after impact. This unique aspect is further heightened in another embodiment when the contact area between the golf ball (B) and the horizontal contact facets (1350) is reduced to a contact area of less than 0.0037 square inches, which is significantly less than both a traditional flat putter face and even a curved putter face that lacks such specifically designed horizontal contact facets (1350).

As seen in FIG. 4, the plurality of horizontal contact facets (1350) includes at least one horizontal contact facet (1350) located at an elevation above the center of curvature elevation (1342) and at least one horizontal contact facet (1350) located at an elevation below the center of curvature elevation (1342). This location of at least two horizontal contact facets (1350) further accommodates another common flaw of the amateur putting stroke, namely the lofting or delofting of the face (1310) at impact. Amateurs commonly have the shaft at an angle other than perfectly vertical at the point when the face (1310) impacts the golf ball (B). It should be noted that the center of curvature elevation (1342) and the face height midpoint elevation (1314) are measured, as seen in FIG. 4, when the putter head (1000) is in the design position with the sole (1500) resting on the turf and the shaft oriented vertically at the design lie angle; one skilled in the art will appreciate that this design position is an easy reference position and is not the intended location of the putter head (1000) at impact with the golf ball (B). Locating the center of curvature (1340) above the sole (1500), while also having at least one horizontal contact facet (1350) above and at least one horizontal contact facet (1350) below the center of curvature elevation (1342), minimizes the effect of a lofting or delofting putting stroke while still ensuring that the golf ball (B) is contacted by no more than two horizontal contact facets (1350).

Unlike a flat face putter, the curvature of the present putter head (1000) has the advantage of producing a straight smooth roll of the ball, even when the toe is inadvertently up or down. It has been demonstrated on a robot in a laboratory that if the typical flat faced putter (with a 4 degree loft) is elevated, in a heel to toe orientation, even just 3.6 degrees that the resultant ball roll will be 6 inches off line towards the player's stance on a 10 foot putt. This is not so with the vertically curved putter face with multiple horizontal contact facets. The ball impact area on the vertically curved putter face (1310) would be lower on the face (1310) and towards the heel (1100), but the resultant geometry of the impact is the same as if the putter head (1000) were horizontal and square to the golf ball (B). The resultant roll is straight.

When viewing the face (1310) head on, as seen in FIG. 5, one skilled in the art will recognize that the sole (1500) typically has a curvature with a radius of 6-14 inches, most commonly 10 inches. As such, locating the face height midpoint elevation (1314) warrants some explanation. First, the vertically outermost edges of the two outermost horizontal contact facets (1350) that have equal facet widths (1352) are located, thus commonly eliminating the uppermost and lowermost facets (1350) from the picture since their widths often vary due to the curvature of the sole (1500) or the top (1600). The outermost edges of these two contact facets (1350) having equal facet widths (1352) are then connected vertically with an imaginary line. The midpoint of this imaginary line establishes the location of the face height midpoint from which the face height midpoint elevation (1314) is then measured vertically to the turf, as seen in FIG. 4, directly inline with the center of gravity (CG), or sweet spot, of the putter head (1000). It is this face height midpoint elevation (1314) that is always greater than the center of curvature elevation (1342), also seen in FIG. 4. Positioning the center of curvature (1340) above the sole (1500) and below the face height midpoint elevation (1314) allows the putter head (1000) to essentially negate the effects of delofting and lofting of the face (1310) at impact, which is common in the amateur putting stroke.

Further embodiments more exactingly place the center of curvature (1340) with respect to the contact facets (1350) to reduce the effects of lofting and delofting the putter face (1310). One such embodiment locates the center of curvature elevation (1342) such that it is less than the face height midpoint elevation (1314) by a magnitude that is at least as great as the facet width (1352). Another embodiment locates the center of curvature elevation (1342) such that the center of curvature elevation (1342) is less than the face height midpoint elevation (1314) by a magnitude that is at least as great as twice the facet width (1352). An even further embodiment combines elements of the previous embodiments and bounds the location of the center of curvature elevation (1342) such that it is both (i) less than the face height midpoint elevation (1314) by a magnitude that is at least as great as the facet width (1352), and (ii) is above the sole (1500). In yet another embodiment, the center of curvature elevation (1342) is at least as twice as great as the facet width (1352).

Figure 2:
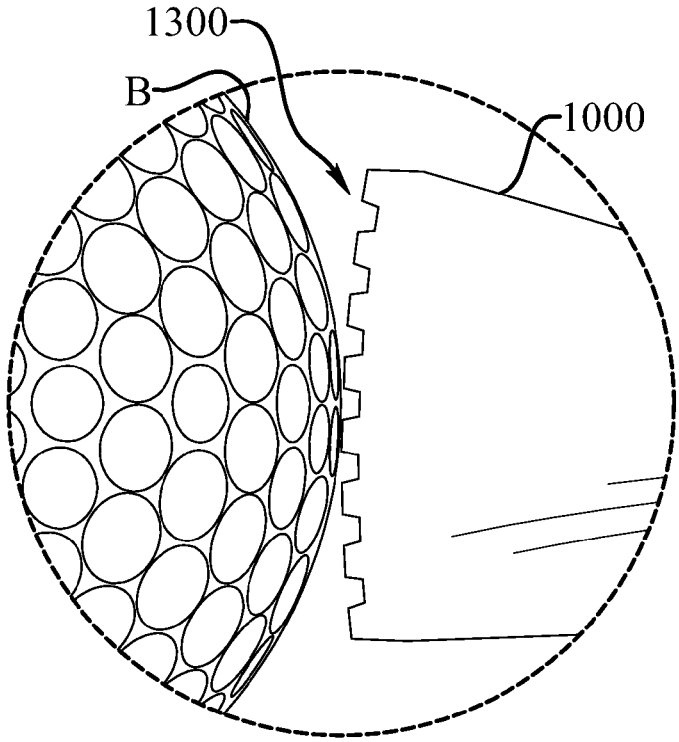
FIG. 2 shows an enlarged side elevation view of a portion of an embodiment of the putter head in contact with the golf ball, not to scale.

Another embodiment of the golf putter head (1000) accounts for golfers that have a good putting stroke and do not loft or deloft the putter face (1310). In this embodiment none of the plurality of horizontal contact facets (1350) are located at the face height midpoint elevation (1314). In this embodiment, when the putter head (1000) strikes the golf ball (B) at the equator, as seen in FIG. 2, a single contact facet (1350) contacts the golf ball (B) thereby further reducing the contact area, while ensuring a horizontally linear contact area, much like blading a pitching wedge.

Additional embodiments further increase the flexibility of the putter head (1000) by increasing the number of contact facets (1350). One such embodiment includes at least five uniformly spaced horizontal contact facets (1350) spaced apart a facet separation distance (1362), seen best in FIG. 6, that is no greater than the facet width (1352). In this embodiment at least two of the five uniformly spaced horizontal contact facets (1350) are located at an elevation below the center of curvature elevation (1342).

Thus far the vertical radius of curvature (1330) has been at least 2 inches and no more than 3.5 inches. This range has been found to provide the exceptional performance attributes previously discussed while also being aesthetically pleasing to the golfer's eye, as golfers generally find that a vertical radius of curvature (1330) of less than 2 inches is too dramatic and resembles a pipe-type cylindrical putter, while a vertical radius of curvature (1330) of greater than 3.5 inches does not ensure that no more than two horizontal contact facets (1350) touch the golf ball (B) at impact. A vertical radius of curvature (1330) that is at least 225% of the radius of a golf ball (B) generally does not adversely influence a golfer when lining up a putt. Yet another embodiment further narrows the range of vertical radius of curvature (1330) for playability, feel, and aesthetics by incorporating a vertical radius of curvature (1330) that is at least 2.75 inches and no more than 3.25 inches.

Figure 7:
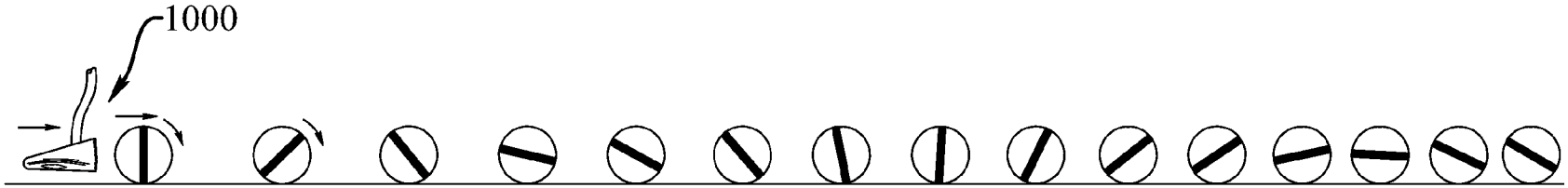
FIG. 7 shows a schematic side elevation view of an embodiment of the putter head striking a golf ball and the associated skidding and rolling of the golf ball, not to scale.

One method of quantifying the performance of the putter head (1000) is through the use of a Putter Efficiency Index (PEI). The PEI is a measure of the amount of kinetic energy possessed by the golf ball (B) once it assumes a true roll, thus a true roll kinetic energy, compared to the initial kinetic energy of the golf ball (B) immediately after impact. A golf ball (B) struck with the putter head (1000) possesses a true roll kinetic energy that is at least 90 percent of the initial kinetic energy when the golf ball (B) is struck in the center of the ball contact portion (1320), or sweet spot, regardless of the elevation of the impact of the golf ball (B) on the face (1310). An even further embodiment illustrates the performance of the putter head (1000) when the golf ball (B) is struck anywhere within ½ inch horizontally from the center of the ball contact portion (1320) regardless of the elevation of the impact of the golf ball (B) on the face (1310). In this embodiment, immediately after impact by at least one of the plurality of horizontal contact facets (1350) the golf ball (B) possesses an initial kinetic energy, and the golf ball (B) possesses a true roll kinetic energy once the golf ball (B) has achieved true rolling characteristics, whereby the true roll kinetic energy is at least 80 percent of the initial kinetic energy when the golf ball (B) is struck. Commercially available software can be purchased to measure the PEI. For instance, an imaging system can be used to determine the initial velocity of a golf ball (B) immediately after impact. Similarly, an imaging system can be used to determine the point at which the golf ball (B) has assumed a true roll, i.e. when it is no longer skidding, and can determine the velocity of the golf ball (B) as it enters the true roll state. Then, knowing the mass of the golf ball (B), the PEI may be calculated. True roll is defined as the point at which one revolution of the golf ball results in a linear travel distance that is equal to the circumference of the golf ball (B). As one skilled in the art will recognize, upon the impact of a putter head (1000) to a golf ball (B) the golf ball (B) tends to skid across the playing surface for a distance before a true rolling state is accomplished, schematically illustrated in FIG. 7.

Figure 8:
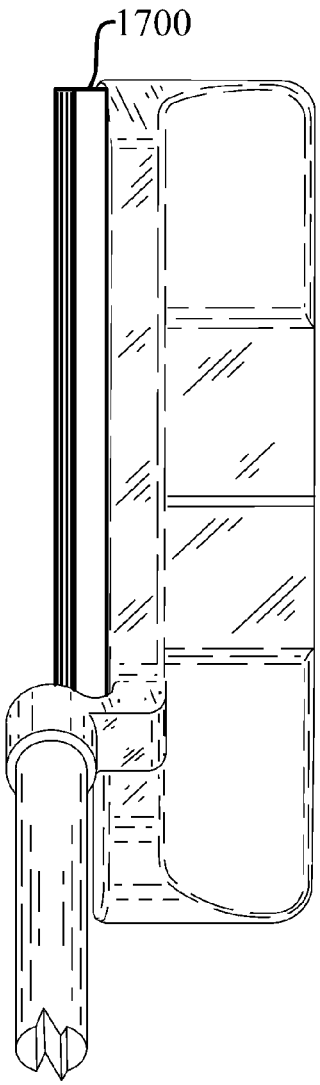
FIG. 8 shows a top plan view of an embodiment of a putter face onsert, not to scale.
Figure 9:
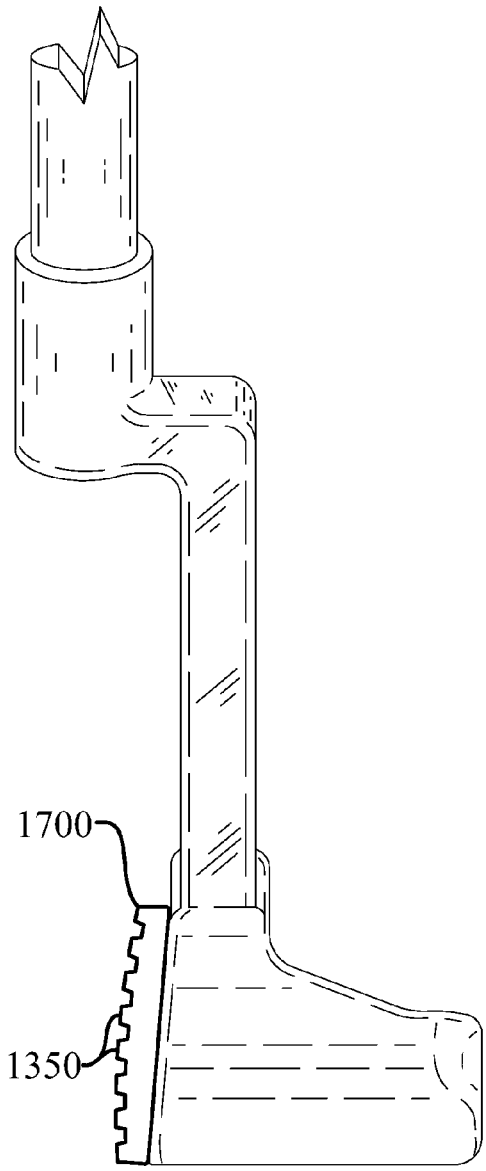
FIG. 9 shows a toe side elevation view of an embodiment of the putter face onsert, not to scale.

All of the previously described benefits associated with a curved putter face with multiple horizontal contact facets (1350) may be incorporated into a putter face onsert (1700) that can be conveniently releasably attached to an existing flat face putter. As seen in FIGS. 8 and 9, the putter face onsert (1700) may possess all the previously described attributes and simply attach to an existing flat face putter so that a golfer may test the changes in performance. All of the previous disclosure will not be repeated here for the sake of brevity; however, one skilled in the art will appreciate that all of the characteristics of the front (1300) of the putter head (1000) are fully disclosed and incorporated into the putter face onsert (1700).

One skilled in the art will appreciate that the putter head (1000) may be constructed of any suitable material including, but not limited to, metals such as aluminum, brass, and steel. Further, the putter head (1000) can be constructed of other materials, including any other natural or synthetic material.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the Claims attached herein.

Numerous alterations, modifications, and variations of the preferred embodiments disclosed herein will be apparent to those skilled in the art and they are all anticipated and contemplated to be within the spirit and scope of the instant putter head. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present putter head are described herein, it is to be understood that the practice of such additional modifications and variations and the equivalents thereof, are within the spirit and scope of the putter head as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A putter face onsert (1700) designed to attach to a flat face putter intended to strike a golf ball (B), comprising:

an onsert body having a heel (1100), a toe (1200), a front (1300), and a back (1400), wherein the front (1300) includes a face (1310) having a face height (1312), a face height midpoint elevation (1314), and a ball contact portion (1320), and the back (1400) releasably attaches to the flat face putter, and wherein:

a) the ball contact portion (1320) is curved vertically having a vertical radius of curvature (1330) and a center of curvature (1340), wherein (i) the vertical radius of curvature (1330) is at least 2 inches and no more than 3.5 inches;

(ii) a portion of the ball contact portion (1320) is above a center of curvature elevation (1342) and a portion of the ball contact portion (1320) is below the center of curvature elevation (1342); and (iii) the center of curvature elevation (1342) is less than the face height midpoint elevation (1314); and b) the ball contact portion (1320) includes a plurality of horizontal contact facets (1350), wherein each contact facet (1350) has a facet width (1352) and a facet length (1354), and wherein:

(i) the facet width (1352) is no greater than 0.07 inches;

(ii) the plurality of horizontal contact facets (1350) includes at least one horizontal contact facet (1350) located at an elevation above the center of curvature elevation (1342) and at least one horizontal contact facet (1350) located at an elevation below the center of curvature elevation (1342); and (iii) no more than two of the plurality of horizontal contact facets (1350) contact the golf ball (B) when struck by the ball contact portion (1320).

2. The putter face onsert (1700) of claim 1, wherein the center of curvature elevation (1342) is less than the face height midpoint elevation (1314) by a magnitude that is at least as great as the facet width (1352).

3. The putter face onsert (1700) of claim 1, wherein the plurality of horizontal contact facets (1350) includes at least five uniformly spaced horizontal contact facets (1350) spaced apart a facet separation distance (1362) that is no greater than the facet width (1352), wherein at least two of the five uniformly spaced horizontal contact facets (1350) are located at an elevation below the center of curvature elevation (1342).

4. The putter face onsert (1700) of claim 1, wherein vertical radius of curvature (1330) is at least 2.75 inches and no more than 3.25 inches.

5. The putter face onsert (1700) of claim 1, wherein immediately after impact by at least one of the plurality of horizontal contact facets (1350) the golf ball (B) possesses an initial kinetic energy, and the golf ball (B) possesses a true roll kinetic energy once the golf ball (B) has achieved true rolling characteristics, whereby the true roll kinetic energy is at least 90 percent of the initial kinetic energy when the golf ball (B) is struck in the center of the ball contact portion (1320) regardless of the elevation of the impact of the golf ball (B) on the face (1310).

6. The putter face onsert (1700) of claim 1, wherein immediately after impact by at least one of the plurality of horizontal contact facets (1350) the golf ball (B) possesses an initial kinetic energy, and the golf ball (B) possesses a true roll kinetic energy once the golf ball (B) has achieved true rolling characteristics, whereby the true roll kinetic energy is at least 80 percent of the initial kinetic energy when the golf ball (B) is struck anywhere within ½ inch horizontally from the center of the ball contact portion (1320) regardless of the elevation of the impact of the golf ball (B) on the face (1310).

* * * * *